United States Patent [19]

Lochmiller

[11] 4,383,609

[45] May 17, 1983

[54] CONTAINER AND SUPPORTING PALLET

[75] Inventor: Eugene C. Lochmiller, Voorhees, N.J.

[73] Assignee: Weyerhaeuser Company, Tacoma, Wash.

[21] Appl. No.: 326,871

[22] Filed: Dec. 3, 1981

[51] Int. Cl.[3] ..... B65D 19/06; B65D 19/20

[52] U.S. Cl. ..... 206/386; 206/600; 217/43 A; 229/23 A; 229/23 C; 229/23 R

[58] Field of Search ..... 206/386, 595–600, 206/577, 586, 320; 220/441, 443, 468; 229/23 R, 37 R, 37 E, 23 BT, 23 A, 23 C; 217/43 A, 12 A, 43 R

[56] References Cited

U.S. PATENT DOCUMENTS

| | | | |
|---|---|---|---|
| 2,167,555 | 7/1939 | Sherman | 220/468 |
| 2,534,010 | 12/1950 | Frye | 206/600 |
| 2,570,340 | 10/1951 | George | 229/23 |
| 2,902,199 | 9/1959 | Breton | 206/386 |
| 2,983,423 | 5/1961 | Vail | 229/23 R |
| 3,337,036 | 8/1967 | Peterson | 206/598 |
| 3,696,988 | 10/1972 | Nederveld | 108/51.3 |
| 4,091,923 | 5/1978 | Collins | 206/386 |

FOREIGN PATENT DOCUMENTS

| | | | |
|---|---|---|---|
| 366194 | 2/1932 | United Kingdom | 229/23 |

*Primary Examiner*—George E. Lowrance
*Assistant Examiner*—Jimmy G. Foster

[57] ABSTRACT

The present invention provides a multi-piece container which locks together. A hinged locking section is attached to each end of a base. Side wall locking members have locking flaps which interact with the hinged locking sections and upper locking flanges which interact with internal locking flaps on the side walls of a side wall section to lock the side walls to the base.

5 Claims, 10 Drawing Figures

CONTAINER AND SUPPORTING PALLET

BACKGROUND OF THE INVENTION

1. Field of the Invention

A container and supporting pallet.

2. Descriptions of Other Art

Collins, U.S. Pat. No. 4,091,923, issued May 30, 1978 discloses a combined carton and supporting pallet.

SUMMARY OF THE INVENTION

A large containers requires a construction different than that shown in the Collins patent in order to provide solidity to the container itself. The present invention provides a multi-piece container which provides solidity to the container and has locking elements which lock the container to the pallet.

DESCRIPTION OF THE PREFERRED EMBODIMENT

Figures 1, 2, 3, 4, 5:
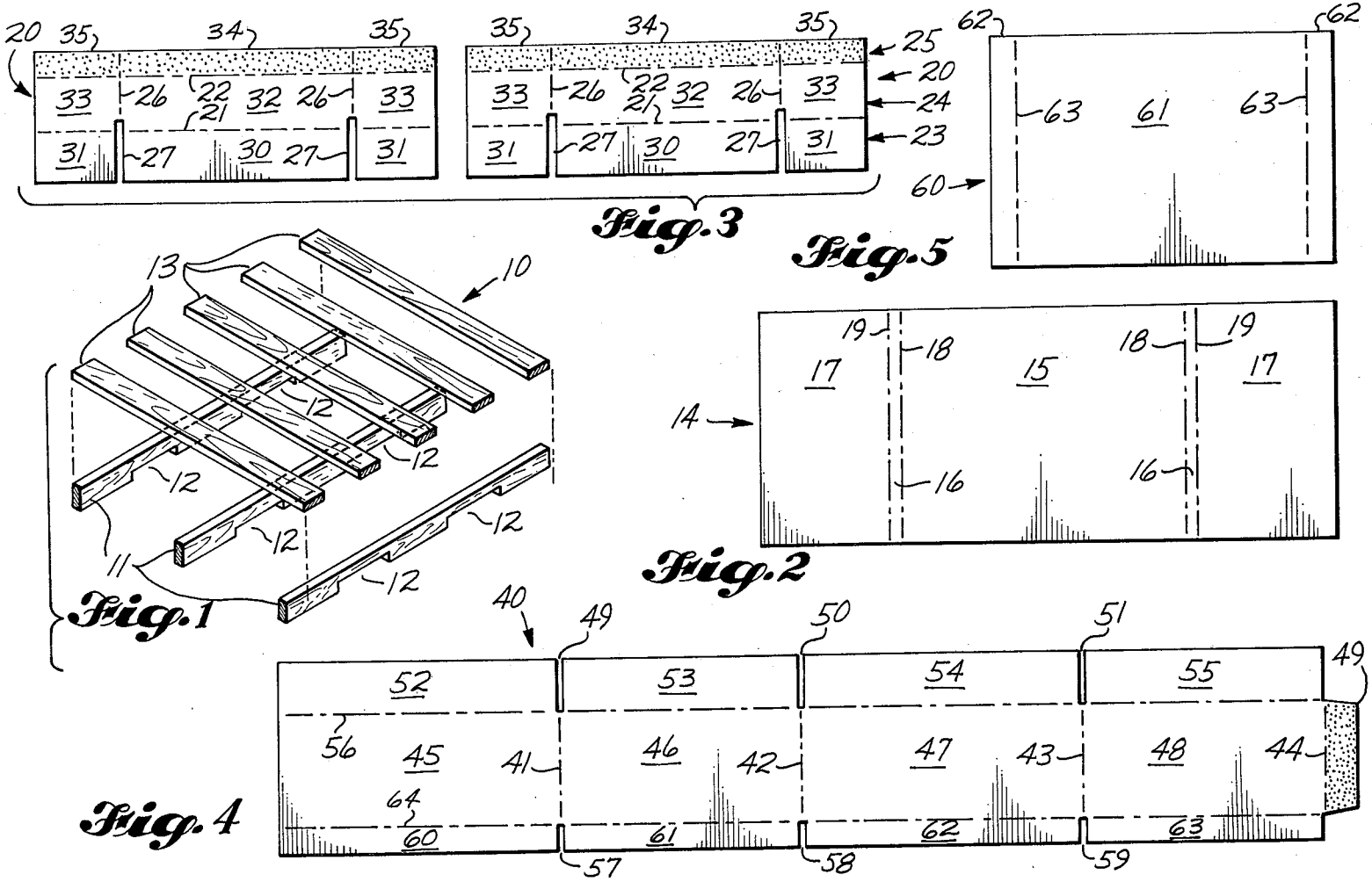
FIG. 1 is an isometric view of the pallet structure.
FIG. 2 is a top plan view of the blank for the locking member which combines with the pallet.
FIG. 3 is a top plan view of the blanks for the side locking members of the construction.
FIG. 4 is a top plan view of the blank for the side walls of the container.
FIG. 5 is a top plan view of the blank for the container cover.

The pallet 10 has spaced parallel legs 11 in which notches 12 are formed. The notches 12, which allow the pallet to be picked up by a fork lift truck, are optional and will depend on the proportions of the unit. The legs are spaced by spacing members 13 which are fastened to the legs 11. The spacing members 13 also carry the weight of the product and attach the base locking member 14 to the legs 11.

The base locking member 14 is shown in FIG. 2. It is divided into a central section 15, side walls 16 and end locking sections 17 by lower score lines 18 and upper score lines 19. The central section 15 rests on the legs 11 and the spacing members 13 are fastened to the legs 11 through the central section 15. Side walls 16 are the same width as the spacing members 13, allowing the base locking member 14 to be wrapped around the end spacing members.

The locking sections 17 hold the side locking members 20 to the pallet. The side locking members 20 are divided by a lower double score line 21 and upper double reverse score line 22 into a lower pallel locking section 23, a side wall section 24 and a side wall locking section 25. These sections are divided by vertical score lines 26 and their aligned slots 27 into central and side sections. The pallet locking section 23 is divided into a central pallet locking flap 30 and side pallet locking flaps 31. The side wall section 24 is divided into a central side wall 32 and wall elements 33. The side wall locking section 25 is divided into a central section 34 and side sections 35. The side wall locking section 25 is bent downwardly around score line 22 and adhered to the outer face of the side wall section 24 to form a locking flange around the upper edge of the side locking member 20. The central sections are the same width as the base locking member 14.

Figure 6:
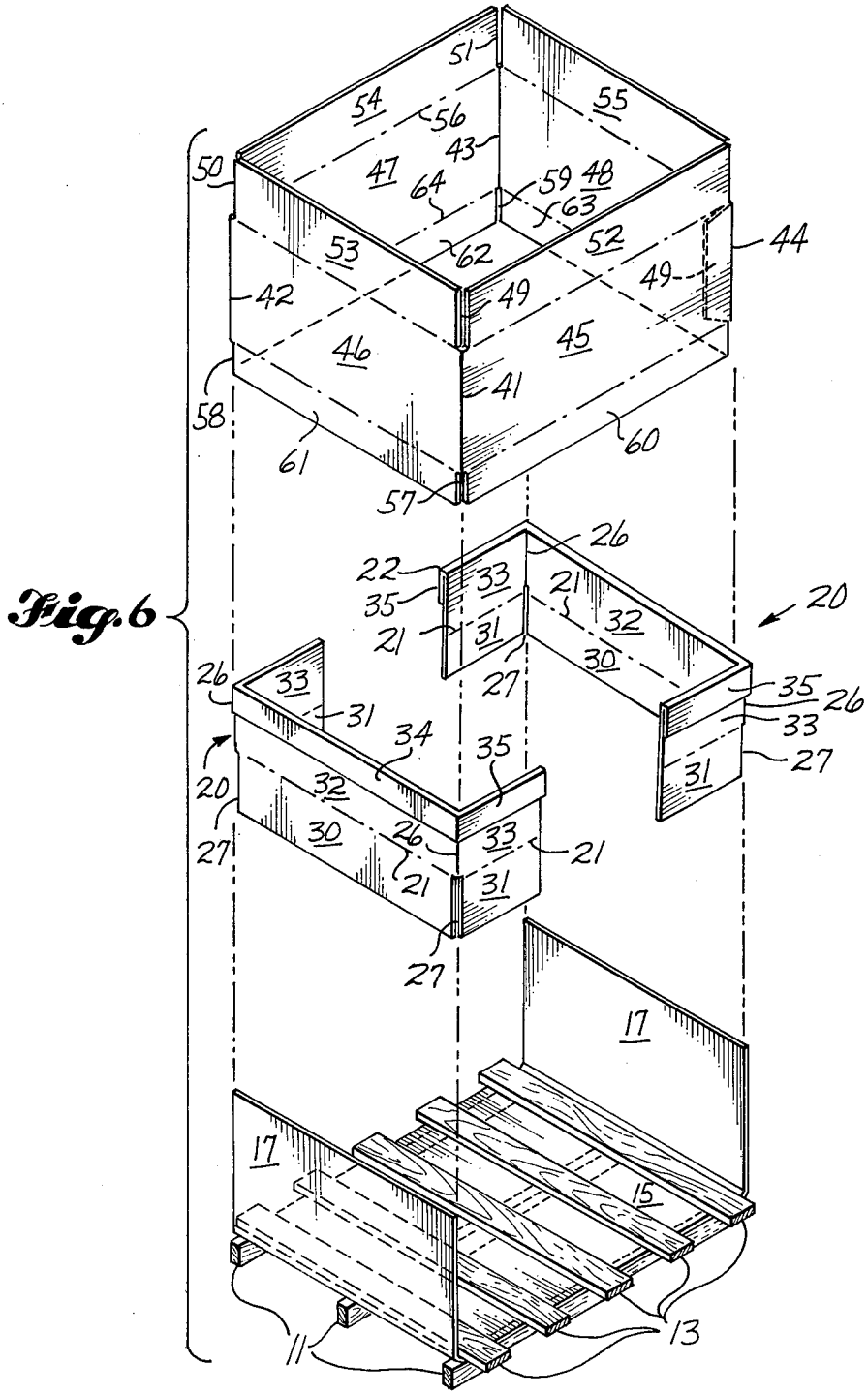
FIGS. 6–8 are isometric exploded views of the container and pallet in different stages of assembly.
Figure 7:
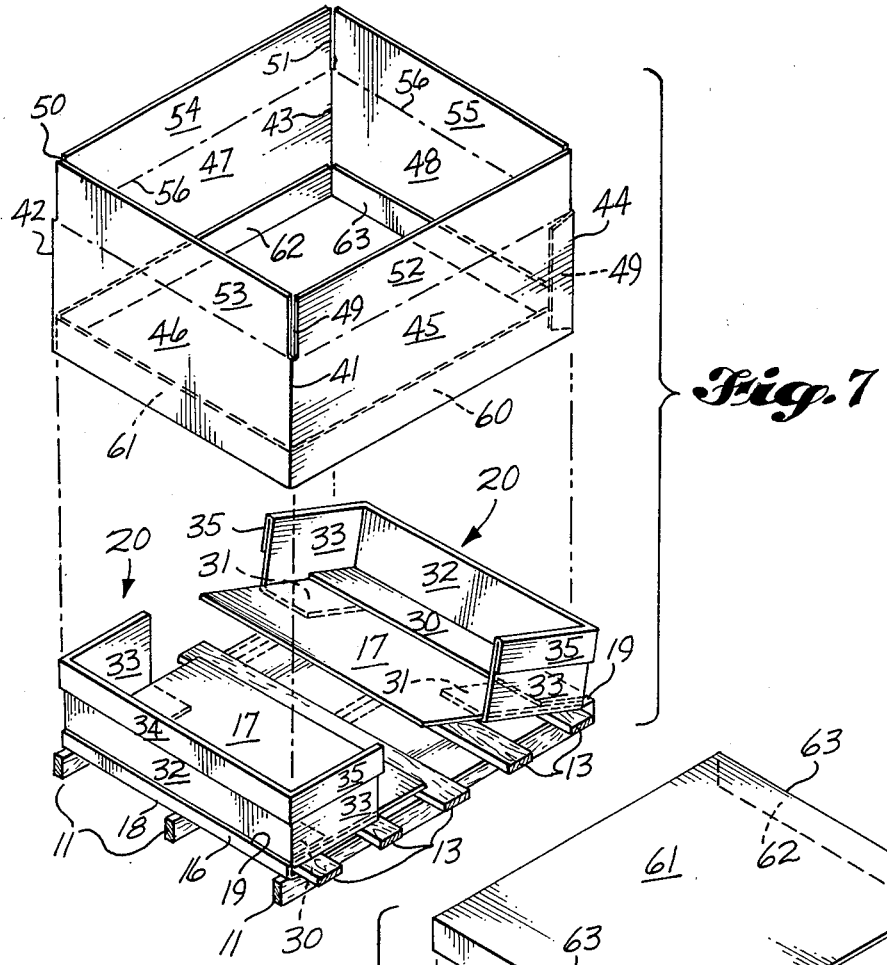
Figure 8:
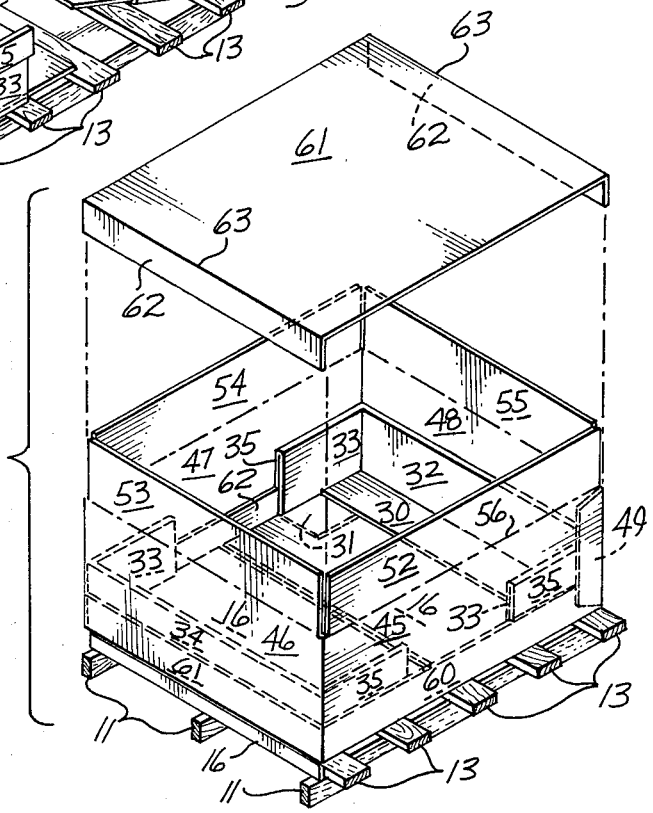
Figure 9:
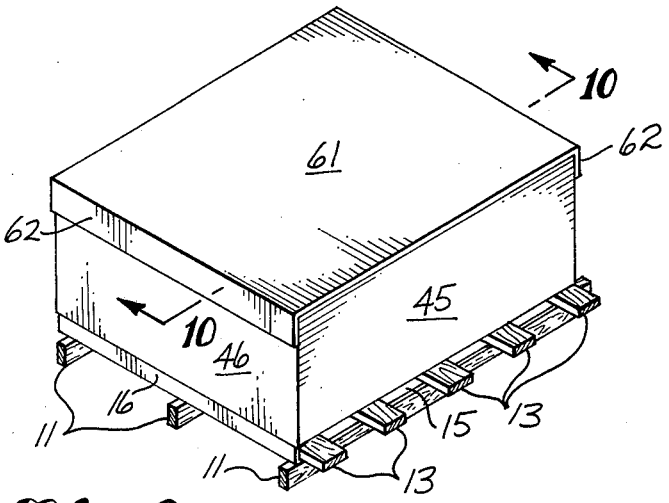
FIG. 9 is an isometric view of the formed container.

The side wall locking sections 20 are bent into a U-shape and attached to the pallet as shown in FIGS. 6–8. The side pallet locking flaps 31 are placed beneath the locking sections 17 and the central pallet locking flap 30 is placed on top of the locking sections 17. The locking sections 17 then are bent downwardly onto the pallet. The weight of product within the container will hold the side wall locking members 20 in place.

The side wall blank 40 is divided by vertical score lines 41, 42, 43 and 44 into side walls 45, 46, 47 and 48 and glue flap 49. Slots 49, 50 and 51, aligned with score lines 41, 42 and 43, respectively, divide the upper edge of the blank into top flaps 52, 53, 54 and 55. These are hinged to their respective side walls by upper horizontal score line 56. Slots 57, 58 and 59, also aligned with score lines 41, 42 and 43, divide the lower edge of the blank into lower locking flaps 60, 61, 62 and 63. These lower locking flaps are hinged to their respective side walls along horizontal double score line 64.

Figure 10:
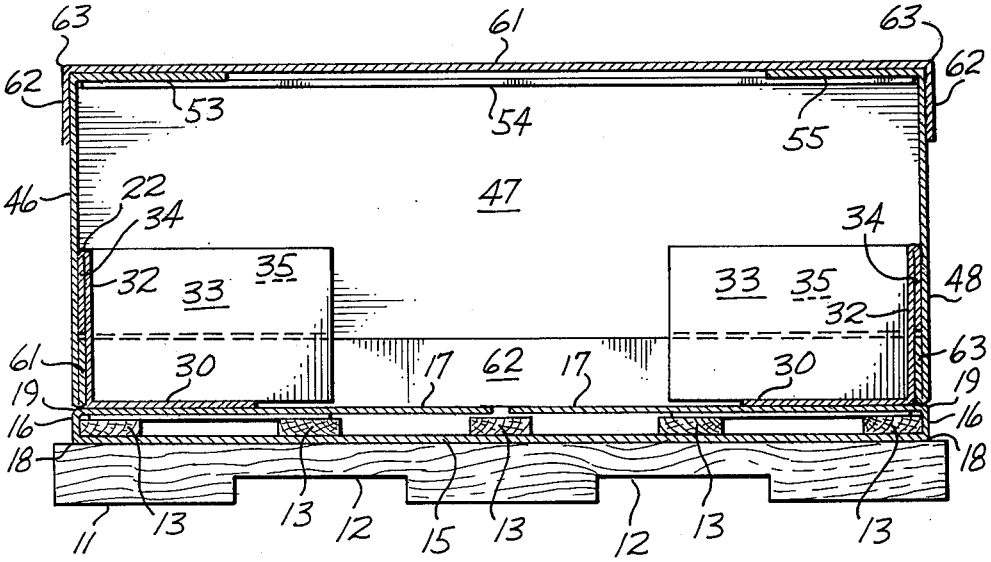
FIG. 10 is a cross sectional view of the container and pallet.

The side wall member is formed by bending the blank around the vertical score lines and adhering glue flap 49 to the outer edge of side wall 45. The lower locking flaps 60–63 are bent inwardly of the side walls around score line 64 and the side walls are telescoped over the side wall locking members 20. The lower locking flaps 60–63 lock beneath the flange formed by locking sections 34 and 35 on the locking members 20 as shown in FIGS. 8 and 10. This locks the side walls to the pallet through the side wall locking members 20.

The upper flaps 52–55 are bent inwardly and the cover element placed over the container and adhered to the container. The cover element 60 is shown in FIG. 5. It has a top cover member 61. Side attachment flaps 62 are connected to member 61 along score lines 63. These score lines also act as hinges for the cover member. Glue or staples are used to attach flaps 62 to the side walls 46 and 48.

I claim:

1. A container comprising a base member, end locking sections hingedly attached to the end edges of said base member, a pair of side wall locking members each locked to one of said end locking sections, each of said side wall locking members having a first central lower locking flap on the top face of one of said end locking sections, and side locking flaps extending between said end locking sections and said base member, a central side wall extending upwardly from said central locking flap along said hinged attachment between said locking section and said base member, side wall elements extending upward from said side locking flaps, a side wall locking flange on the upper edge of said central side wall and said side wall elements, a rectangular side wall member telescoped around the outer edge of said side wall locking members, said side wall member having side walls, side wall locking flaps extending from the lower edge of each side wall, said side wall locking flaps being hingedly attached to said side walls and extending upwardly internally of said side walls and mating with said flange.

2. The container of claim 1 in which said flange is formed of side wall locking elements hingedly attached to the upper edge of said side walls, said side locking elements extending downwardly from the upper edge of said side walls.

3. The container of claims 1 or 2 further comprising legs on said base member.

4. The container of claims 1 or 2 further comprising a cover on said container.

5. A method of forming a container comprising providing a base member having end locking sections hingedly attached to the end edges of said base member, providing a pair of side wall locking members having three hingedly connected side walls, an upper locking flange and lower locking flaps, placing the central locking flap of each of said side wall locking members against the outer face of one of said locking sections, placing the side locking flaps of each of said side wall locking members against the lower face of one of said locking sections, bending the locking sections down onto the base member, providing a four-sided tubular element having the side wall locking flaps hingedly attached to the lower edge of each of said side walls, bending said side wall locking flaps inwardly into said tubular element, telescoping said side walls over said side wall locking members until said side wall locking flaps are beneath said flange.

* * * * *